United States Patent [19]

Watson

[11] 3,989,583

[45] Nov. 2, 1976

[54] VARIABLE RATE LABELING SYSTEM

[75] Inventor: Donald W. Watson, Arlington Heights, Ill.

[73] Assignee: Xerox Corporation, Stamford, Conn.

[22] Filed: Nov. 15, 1974

[21] Appl. No.: 524,100

[52] U.S. Cl. ..... 156/568; 156/497; 156/DIG. 29; 271/96; 271/196; 271/276

[51] Int. Cl.[2] ..... B65C 9/08; B65H 5/22

[58] Field of Search ..... 156/568, 567, 566, 571, 156/552, 108, 497, 364, DIG. 31, DIG. 45, DIG. 46, 521, 362, DIG. 29; 271/94, 96, 108, 196, 276

[56] References Cited

UNITED STATES PATENTS

| | | | |
|---|---|---|---|
| 3,455,274 | 7/1969 | Modersohn | 271/96 X |
| 3,488,241 | 1/1970 | Faltot | 156/364 |
| 3,545,746 | 12/1970 | Ledger et al. | 271/196 |
| 3,652,082 | 3/1972 | Eder | 156/364 |
| 3,684,627 | 8/1972 | Hottendorf | 156/566 X |

FOREIGN PATENTS OR APPLICATIONS

| | | | |
|---|---|---|---|
| 1,159,375 | 7/1969 | United Kingdom | 156/571 |

*Primary Examiner*—William A. Powell
*Assistant Examiner*—M. G. Wityshyn

[57] ABSTRACT

A labeling system for automatically fixing information bearing labels to articles includes: a conveyor belt; means for placing articles on the conveyor belt at a variable periodic rate; a source of labels providing labels at said periodic rate; and a label transfer wheel, coupled to the drive source, for fixing each of the labels from the source to a different one of the articles. The label transfer wheel has a cylindrical surface, a stationary chamber communicating with a vacuum source, and a plurality of holes on the surface which periodically communicate with the chamber to pneumatically hold labels as they are transferred from the label source to the articles.

7 Claims, 5 Drawing Figures

Fig. 1a
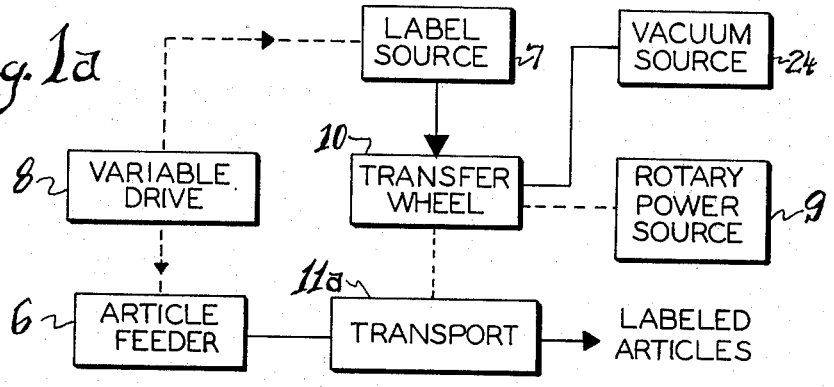
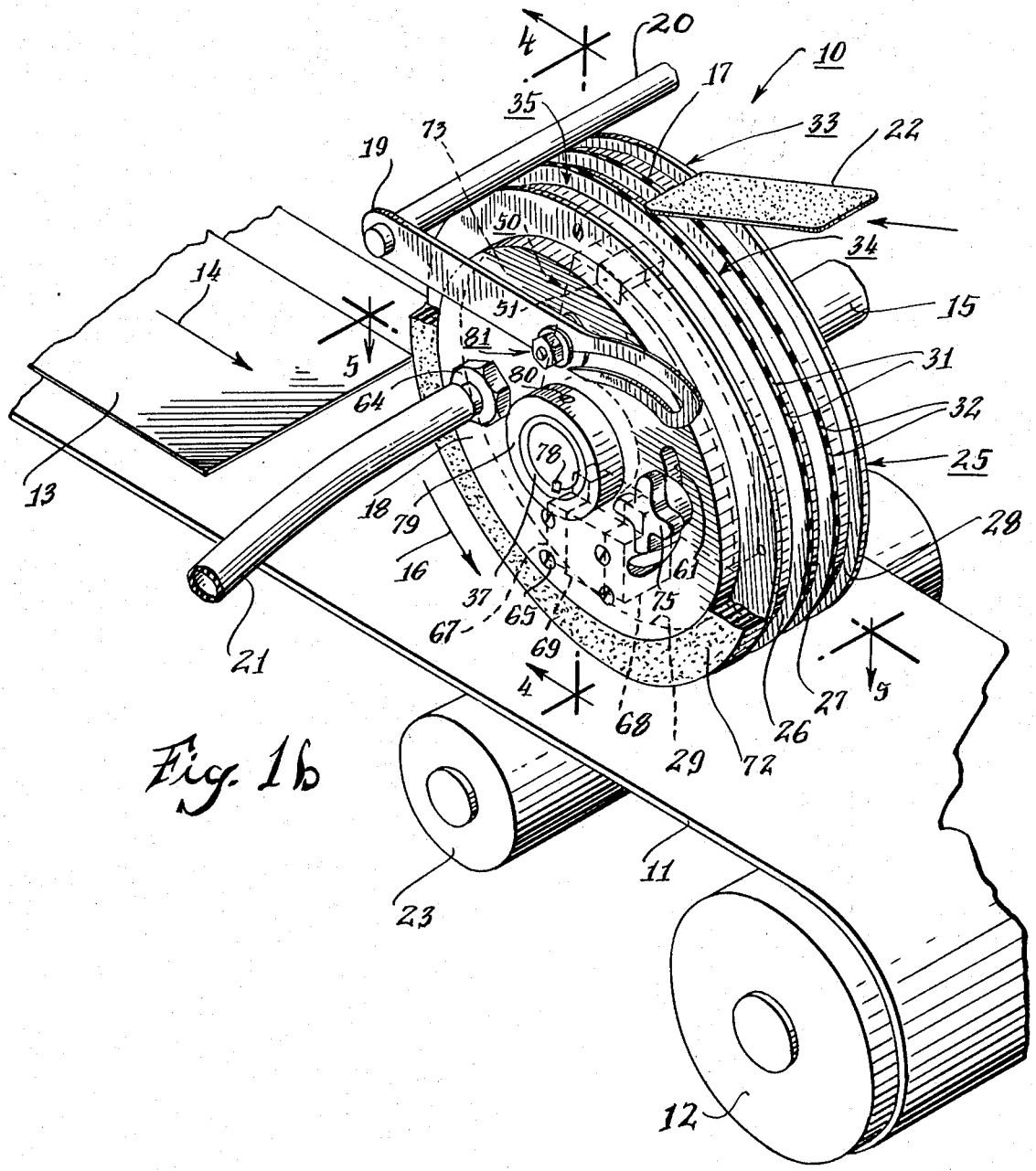
Fig. 1b

VARIABLE RATE LABELING SYSTEM

The subject invention relates to systems and apparatus labels and/or information thereon to articles such as envelopes.

Persons skilled in the art of addressing bulk mail are familiar with machines, such as disclosed in U.S. Pat. No. 3,711,357, wherein labels are fed to a transfer wheel and the transfer wheel carries the label into engagement with an article at a transfer station, movement of the article to the transfer station being accomplished with a conveyor belt. Typically, as is disclosed in the referenced patent, the wheel includes a radial land portion provided with vacuum ports for holding labels and rotation of the wheel is synchronized to bring labels into contact with articles without relative motion therebetween. The wheel is capable of applying one label per revolution provided that labels are fed at the same periodic rate and the articles are spaced by a distance equal to a circumference computed using the radial displacement of the land on the wheel. In such systems the radial land portion must be at a predetermined angular position in order to receive a label and, therefore, the feeding of labels must be synchronized with the rotation of the wheel. Thus, it may be seen that synchronization is required between the conveyor belt, the wheel, and whatever means are used to feed labels. Moreover, the placement of articles on the conveyor belt must be keyed to the location of the radial land portion to ensure label transfer at the transfer station. From the foregoing it will be apparent that the labeling rate can only be varied if all of the synchronized components of the machine are varied.

Accordingly, it is an object of the present invention to provide a labeling system of the type wherein a labeling wheel applies labels to articles on a transport, the articles on the transport being spaced by a distance which is not necessarily related to dimensions of the labeling wheel.

It is another object of the present invention to provide a labeling system of the type having a transfer wheel, wherein the feed rate of articles to be labeled need not be equal to the angular velocity of the transfer wheel and may be varied relative thereto.

Briefly, the subject invention provides a system for automatically pressing labels bearing information against articles. Structurally, the system includes: (a) an article transport; (b) means for placing articles on the transport at a periodic rate; (c) a source of labels, the source providing labels at said periodic rate; (d) a rotary power source; and (e) a label tranfer wheel, coupled to the power source, for pressing without substantial sliding each of the labels from said label source against a different one of the articles, the rotation rate of the transfer wheel and said periodic rate being relatively variable. With this arrangement, the information on the labels is applied to the articles.

Additional objects and features of the subject invention will become apparatus by reference to the following description in conjunction with the accompanying drawings, in which:

FIG. 1*a* is a block diagram of a system, according to the invention;

FIG. 1*b* is a partial perspective view of an embodiment according to the invention;

Figure 2:
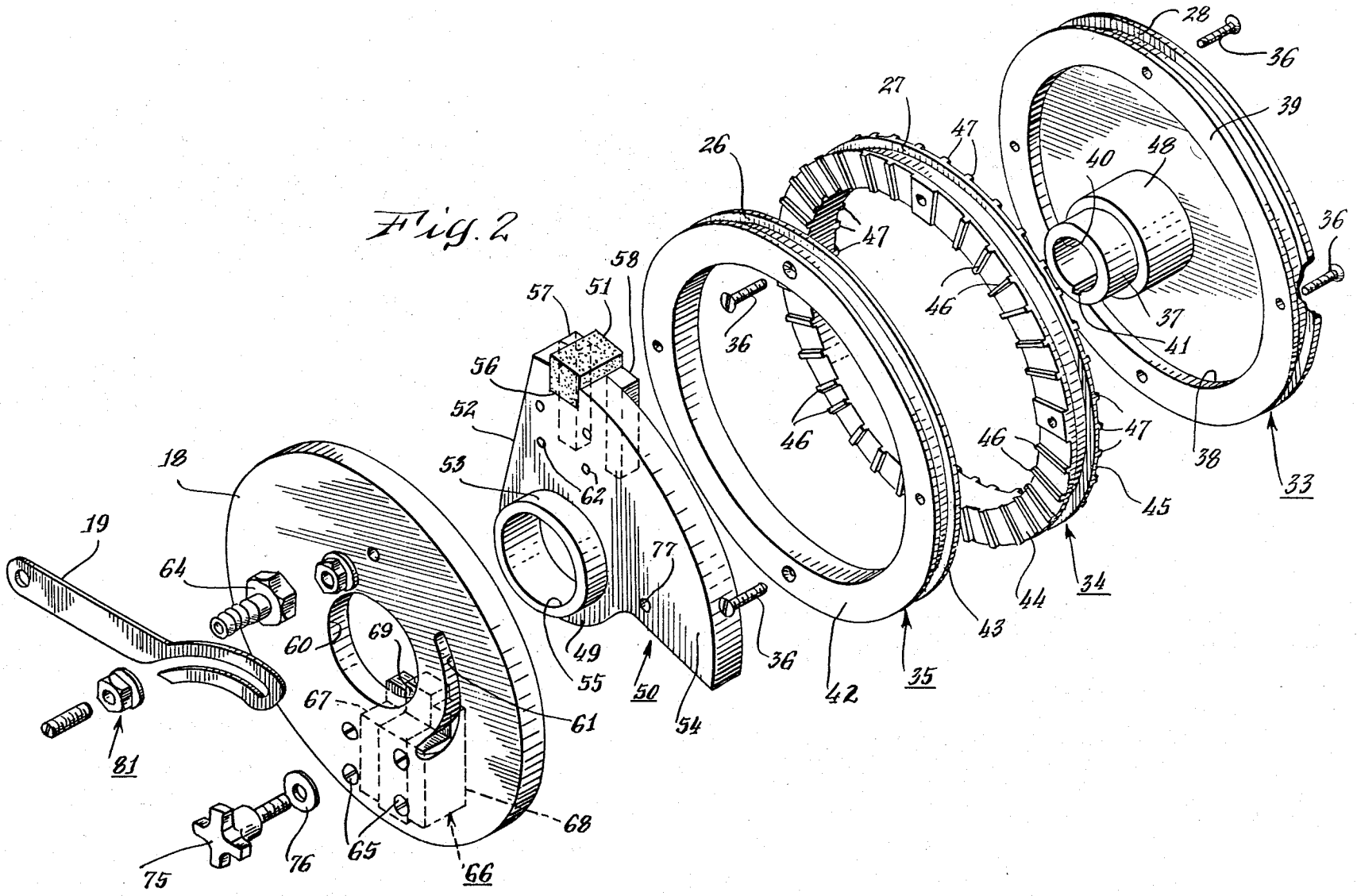
FIG. 2 is an exploded perspective view of a label transfer wheel shown in FIG. 1*b;*
Figure 3:
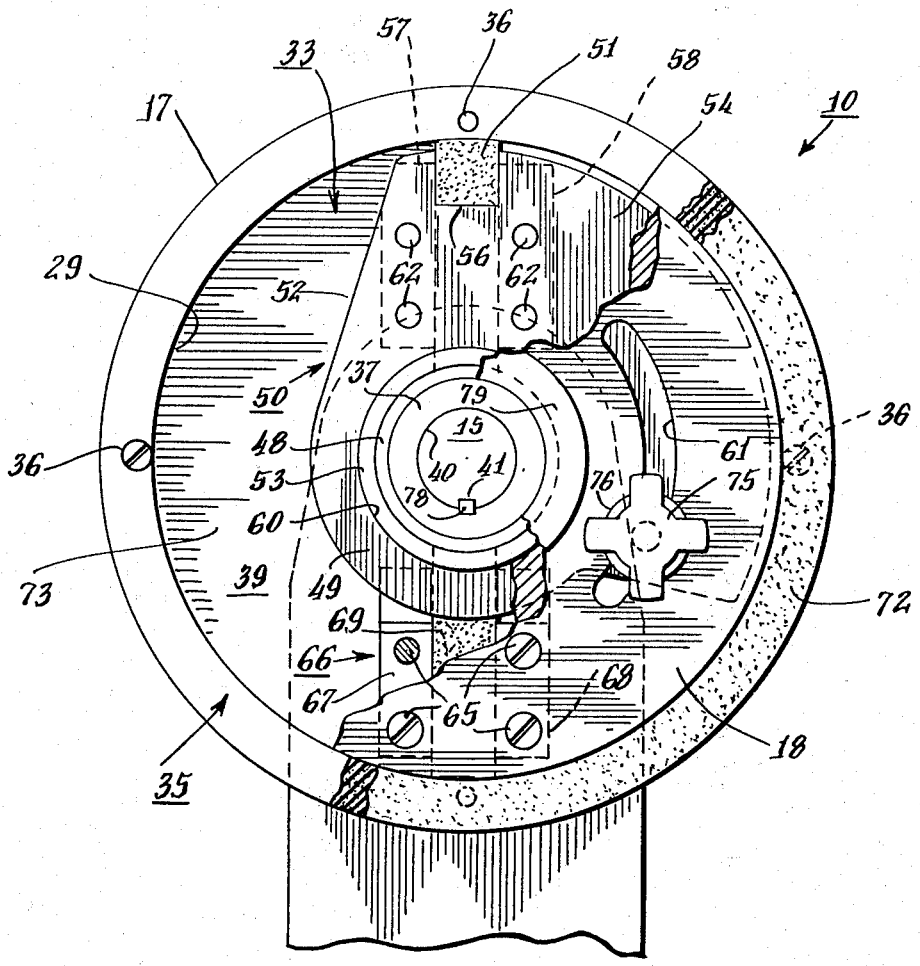
FIG. 3 is a front plan view of the label transfer wheel, a portion having been removed to show a chamber thereof.

Referring to FIG. 1*a*, a system according to the present invention includes a transport 11*a*, and article feeder 6 periodically supplying articles to the transport, a source of labels 7, and a label transfer wheel 10 for applying the labels to the articles. Variable drive means 8 control the label source and the article feeder such that labels and articles are fed at the same rate but with a suitable delay in either the label source or the feeder to ensure timely delivery of the labels to the articles. As more fully discussed below, a rotary power source 9 drives the wheel at a uniform rate which substantially eliminates sliding between labels being applied to the articles. In the system shown the rate at which labels and articles are fed is variable to control the spacing of articles placed on the transport and therefore, the maximum rate at which articles of a particular size may be labeled.

FIG. 1*b* shows in perspective apparatus for implementing the system. In the implementation set forth the transport 11*a* is a horizontally disposed conveyor belt 11 which driven by a drive roll 12 to transport an article, such as an envelope 13 in the direction of arrow 14. Transfer wheel 10 is axially supported in near contact with the top of conveyor belt 11 by a drive shaft 15, the shaft being disposed in parallel with the top surface of conveyor belt 11 and perpendicular to the direction of travel 14 of the belt. Shaft 15 is rotated by a rotary drive source 9, such as a motor, in the direction indicated by arrow 16 so as to provide a cylindrical surface 17 on the transfer wheel 10 with a tangential velocity which is equal to the velocity of the belt 11. As more fully discussed below, transfer wheel 10 includes a slidable plate 18 securely held by an arm 19 extending from a rod 20 fixed to a machine frame (not shown). Plate 18 is a coupled by a hose 21 to a vacuum supply 24 (see FIG. 1*a*) to provide within the transfer wheel 10 a vacuum pressure. The vacuum pressure within the wheel is used to hold labels 22 against the cylindrical surface 17 while they are transported from the label source 7 into contact with, for example, envelope 13. A pressure roll 23 is provided directly below the transfer wheel 10, on the underside of conveyor belt 11, to provide support when a label is pressed into contact with an envelope. The label 22 may have an adhesive coating at the time it is fed to the transfer wheel 10 or an adhesive may be applied to the label as it is rotated by the wheel in either case of which the pressure generated between the wheel 10 and the pressure roll 23 fixes the label to an envelope 13 passing therebetween.

Referring to FIGS. 1*b*–5, transfer wheel 10 includes a cylindrical structure 25 having three spaced annular grooves 26–28 extending into the structure from cylindrical surface 17 and an annular cavity 29 extending concentrically with the axis of the structure into a side thereof. In addition, between grooves 26 and 27 there is circularly disposed a series of holes 31 and between grooves 27 and 28 there is circularly disposed another series of holes 32, each of the holes in series 31 and 32 extending from the cylindrical surface 17 into communication with annular cavity 29. Referring to FIG. 2, cylindrical structure 25 may include, according to one manufacturing technique, a base member 33, an annular central member 34, an annular top 35, and screws 36 which fasten members 33–35 together. In this embodiment, base member 33 is circular and includes an axially extending hub 37, an annular recess 38 extending into a flat surface 39 about the hub, and the annular groove 28. Hub 37 includes an axial bore 40 and a radial slot 41 adapted for engagement with drive shaft 15 (see FIGS. 1 and 4). Top member 35 is a ring-like configuration having flat and parallel side surfaces 42 and 43 and annular groove 26 therebetween. Central member 34 also has a ring-like configuration in which annular groove 27 is located. Generally, the sides 44 and 45 of member 34 are plane and parallel. However, each of the sides 44 and 45 includes radial projections 46 and 47 adapted to abut surfaces 43 and 39, respectively, when members 33–35 are fastened with screws 36. Thus, it will be appreciated that projections 46 and 47 define the series of holes 31 and 32, respectively. All of the projections 46 and 47 extend to the outer edge of central member 34 and, therefore, each of the holes in the series 31 and 32 provide an arcuate entrance on cylindrical surface 17 of the structure. With this arrangement, when labels are brought into contact with the wheel the vacuum pressure applied to the label is maximized.

Figure 4:
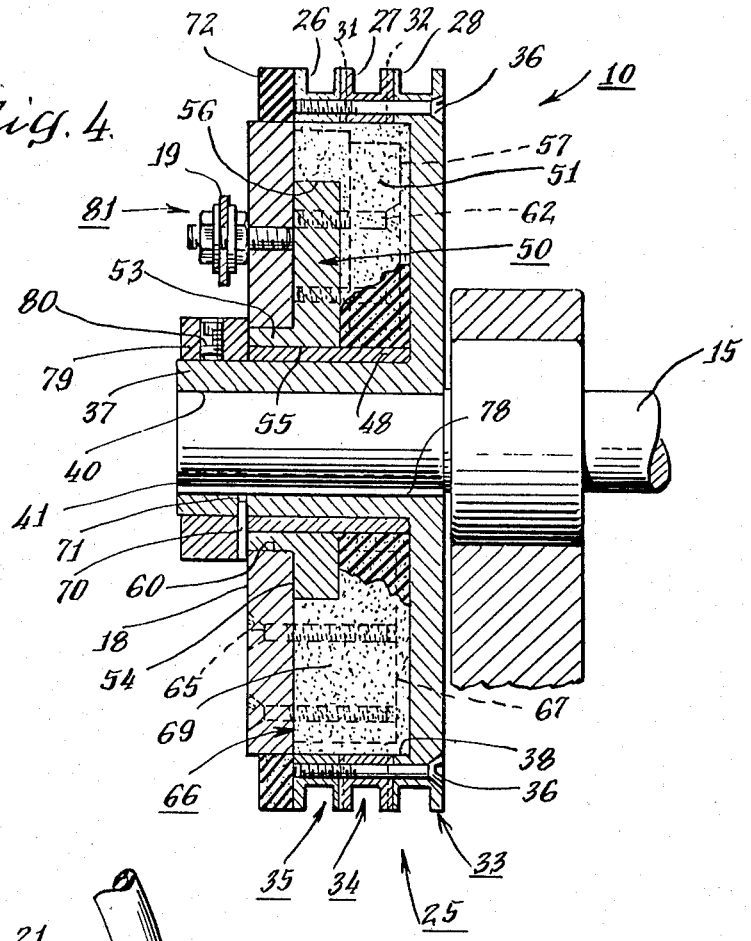
FIG. 4 is a cross-sectional view of the label transfer wheel, taken along lines 4—4 of FIG. 1*b.
Figure 5:
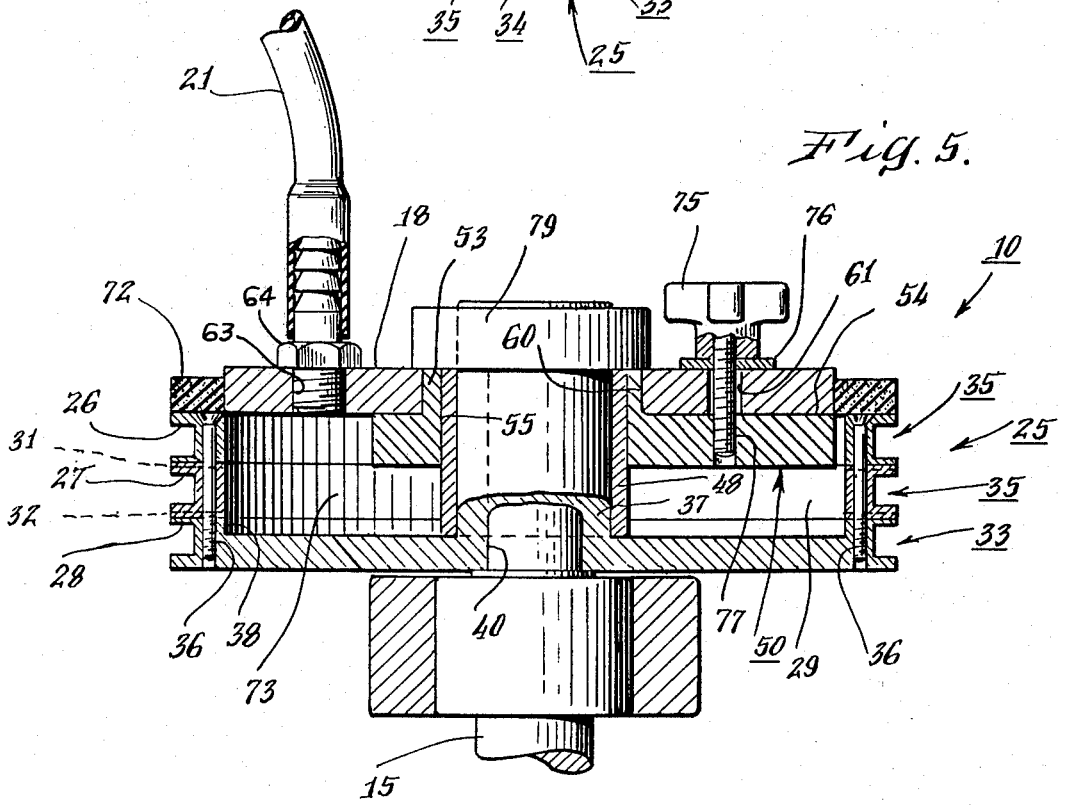
* and FIG. 5 is a cross-sectional view of the label transfer wheel taken along lines 5—5 in FIG. 1*b*.

Referring to FIGS. 2, 4, and 5, hub 37 supports a bushing 48 about which a device 50 for holding an elastic seal 51 is rotatably mounted. Device 50 includes: an arcuate section 49 which extends into a section 52, a hub 53 coaxial with the arcuate section and extending from one side 54, a bore 55 adapted to rotatably engage the bushing, and a radially extending notch 56 on the periphery of the sector section. The other side of the device 50 includes a pair of brackets 57 and 58 secured thereto with screws 62. Between the brackets 57 and 58 there is radially located the elastic seal 51. Typically, seal 51 is an L-shaped piece of polyurethane foam which extends through the notch 56. In addition, seal 51 extends from between the brackets 57, and 58, and beyond the periphery of the sector to engage under compression, when the device is operationally mounted on the hub 37, a radial segment of the recess 38 and the cylindrical surface of the structure bounding the cavity (see FIG. 4). As a result, seal 51 provides a fluid tight seal from one side of the cavity to another.

Circular plate 18 includes an axially located hole 60 adapted to rotatably engage hub 53, an arcuate slot 61, and a port 63 adapted to threadably engage and support a hose coupling 64 (see FIG. 5). As shown in FIG. 4, screws 65 rigidly couple to plate 18 a device 66 comprising a pair of L-shaped brackets 67 and 68 spaced apart to radially support therebetween an L-shaped elastic seal 69. As with seal 51, seal 69 may be manufactured from polyurethane foam. When plate 18 is mounted on hub 53 the brackets 67 and 68 extend under the arcuate section 49 and the seal abuts, under compression, the periphery of the arcuate section 49, the bushing 48, a radial segment of the recess 38, and the cylindrical surface bounding the cavity. This arrangement also provides a fluid tight seal from one side of the cavity to another.

Plate 18 is rotatably secured to the hub 53 by, for example, a pin 70 extending into a hole in hub 37. When plate 18 is secured, it covers the cavity 29 and a circular seal 72 fixed to the structure 25 provides a fluid tight seal between the plate 18 and the structure

25. Thus, the plate 18 and seals 51 and 69, and 72 provide a chamber 73 (see FIG. 5) which communicates with port 63. Device 50 is rotatable with respect to plate 18 and, therefore, the size of the chamber and the number of holes from the series 31 and 32 communicating therewith may be varied. Once a size has been selected for the chamber, the relative angular positions between the seals 51 and 69 may be set and fixed. In this embodiment fixing is achieved (see FIG. 5) with a bolt 75 and washer 76. Structurally, the bolt 75 passes through the washer 76, through the arcuate slot 61, and threadably engages a hole 77 in the device. As a result, the bolt may be moved within the arcuate slot to rotate the device 50. Rotation of device 50 with respect to plate 18 varies the angular distance between the seals 51 and 69, the volume of the chamber and the number of holes from the series communicating therewith.

Referring to FIGS. 1*b* , 4, and 5, tranfer wheel 10 may be mounted on a rotatable drive shaft 15 having a key 78 engageable with slot 41 and the wheel may be retained on the drive shaft with conventional means such as a collar 79 and a set screw 80 coupling the collar to the drive shaft.

If, as shown in FIG. 1*b*, plate 18 is coupled by a fastener 81 to a stationary arm 19 and drive shaft 15 is rotated, vacuum supplied to the chamber via the coupling 64 and port 63 creates a vacuum pressure in holes of the series communicating with the chamber. As the wheel rotates different holes periodically communicate with the chamber to provide a vacuum pressure along a stationary area contiguous with the cylindrical surface 17. It will now be appreciated that if a label 22 is fed to one end of the area it will be attracted by the vacuum pressure against the cylindrical surface 17 and will be transported by the rotating wheel. When the label reaches the other end of the area vacuum attraction terminates. Typically, attraction terminates at a transfer station where the label 22 is pressed into engagement with an envelope 13.

From the foregoing it may be noted that the rotating transfer wheel 10 may be used to transfer address labels as they are fed into the arcuate area on the cylindrical surface. As previously mentioned, label 22 may include a pressure sensitive adhesive so that when the label engages the envelope pressure between the wheel 10 and the pressure roll fixes the label to the envelope. If desired, labels without an adhesive may be fed to the wheel and glue may be applied to the labels as they are advanced. In this mode of operation rotatable disks bearing glue on their periphery, such as described in a U.S. Pat. No. 3,868,292, granted Sept. 25, 1975, to R. Ernest et al, may be disposed to contact the labels in areas covering the annular grooves 26–28. With this arrangement, when no labels are being fed the disks do not contact the wheels.

In the system described above the rate at which labels and envelopes are fed is variable to control the space between the envelopes placed on the conveyor belt and, therefore, the maximum rate at which envelopes of a particular length may be labeled. However, it should be noted that for a given feed rate the use of a variable speed drive for the wheel and belt may be used to minimize the speed required to label envelopes of a particular size.

It is to be understood that the description herein of a preferred embodiment according to the invention, is set forth as an example thereof and is not to be construed or interpreted as a limitation on the claims which follow and define the invention.

What is claimed is:

1. A system for automatically pressing labels bearing information against delivered articles, comprising:

a. an article transport;

b. means for placing articles on the transport at a periodic rate;

c. a source of labels, the source providing labels at said periodic rate;

d. a rotary power source;

e. a vacuum source;

e. a label transfer wheel, coupled to the power source and continuously rotatable thereby at a constant speed, for pressing without substantial sliding each of the labels from said label source against a different one of the articles, the instantaneous angular position of the wheel being independent of the location of articles on the transport, the rotation rate of the transfer wheel and said periodic rate being relatively variable, whereby information on the labels is applied to the articles, the transfer wheel including: a cylindrical structure having an annular cavity axially extending into a side thereof and a plurality of holes disposed about the cylindrical surface of the structure, said holes radially communicating with the cavity; and means rotatable coupled to the structure for providing from the cavity a chamber with a port, at least one of the holes communicating with the chamber and said port being coupled to the vacuum source whereby as the cylindrical structure is rotated with respect to the means providing the chamber vacuum pressure is periodically applied to the holes; and wherein said means for providing a chamber includes: a plate rotatably coupled to the structure; an annular seal for providing a fluid tight seal between the plate and the structure; a first device, coupled to the plate, for providing a fluid tight radial wall in the cavity; and a second device, coupled to the plate, for providing another fluid tight radial wall in the cavity, said port being located in the plate, one of the devices being securely fastened to the plate while the other of the devices is rotatably coupled to the plate, whereby the angular distance between the walls may be varied.

2. A system as defined in claim 1 wherein said plurality of holes includes a series of holes disposed in an imaginary plane perpendicular to the axis of the cylindrical structure.

3. A system as defined in claim 2 wherein each of the holes has an opening contiguous with the cylindrical surface.

4. A system as defined in claim 3 wherein said series of holes is located between a pair of annular grooves on the cylindrical surface.

5. A system as defined in claim 1 wherein said plurality of holes extend radially within the cylindrical structure.

6. A system as defined in claim 5 wherein each of the holes has an opening contiguous with the cylindrical surface.

7. A transfer wheel as defined in claim 6 wherein said plurality of holes are located between a pair of annular grooves on the cylindrical surface.

* * * * *